US006354284B1

(12) United States Patent
Nakano et al.

(10) Patent No.: US 6,354,284 B1
(45) Date of Patent: Mar. 12, 2002

(54) INTAKE DEVICE FOR MULTI-CYLINDER ENGINE

(75) Inventors: Keiichi Nakano; Kiyoharu Kimoto; Tamotu Oohashi; Syunji Okano, all of Sakai (JP)

(73) Assignee: Kubota Corporation (JP)

( * ) Notice: Subject to any disclaimer, the term of this patent is extended or adjusted under 35 U.S.C. 154(b) by 52 days.

(21) Appl. No.: 09/640,086

(22) Filed: Aug. 17, 2000

(30) Foreign Application Priority Data

Nov. 16, 1999 (JP) ..... 11-324813

(51) Int. Cl.[7] ..... F02M 33/02
(52) U.S. Cl. ..... 123/591; 123/336
(58) Field of Search ..... 123/591, 336, 123/337, 184

(56) References Cited

U.S. PATENT DOCUMENTS 4,381,756 A * 5/1983 Waschkuttis ..... 123/591
5,572,979 A * 11/1996 Czadzeck ..... 123/591

FOREIGN PATENT DOCUMENTS

| | | | |
|---|---|---|---|
| GB | 2 060 765 A * | 5/1981 | ..... 123/591 |
| JP | 50-14026 | 4/1975 | |
| JP | 7-83133 | 3/1995 | |
| JP | 7-310599 | 11/1995 | |

* cited by examiner

*Primary Examiner*—John Kwon
(74) *Attorney, Agent, or Firm*—Bacon & Thomas PLLC

(57) ABSTRACT

An intake device for a multi-cylinder engine comprises a cylinder head (23) which has an inner portion provided with a fuel-air mixture inlet (10), passages (11),(11) branched from this mixture inlet (10), and intake ports (12),(12) communicated with the respective branched passage (11), (11). A mixing passage (4) of a carburetor (1) has an outlet (4*a*) communicated with the mixture inlet (10). A slow port (6) is formed in a ceiling wall (4*b*) of the mixing passage (4) so as to face downwards. A mixture passage portion (7*a*) positioned downstream of this slow port (6) and upstream of the mixture inlet (10) has a peripheral wall provided with a liquid fuel receiver (31).

19 Claims, 3 Drawing Sheets

INTAKE DEVICE FOR MULTI-CYLINDER ENGINE

BACKGROUND OF THE INVENTION

1. Field of the Invention

The present invention relates to an intake device for a multi-cylinder engine.

2. Description of Prior Art

A conventional intake device for a multi-cylinder engine has a slow port formed in a ceiling wall of a mixing passage of a carburetor. According to this intake device, there is a likelihood that liquid fuel overflowed on a ceiling wall surface of the mixing passage from the slow port is blown downstream along an inner wall surface of the mixing passage. However, the conventional intake device lacks a means which accelerates atomization of the liquid fuel to be blown downstream from the slow port of the ceiling wall. This entails a case where the liquid fuel flows, as it remains liquid, into each of intake ports formed within a cylinder head. In this case, the fuel is distributed to respective cylinders non-uniformly to result in excessive or insufficient fuel supply. This causes mis-ignition or increases CO concentration in the exhaust gas.

Further, most of conventional intake devices each attaches a carburetor to a cylinder head through an intake manifold. Thus the carburetor projects from the cylinder head largely, which causes an engine to become large.

SUMMARY OF THE INVENTION

The present invention has an object to provide an intake device for a multi-cylinder engine, which can solve the foregoing problems.

An invention of claim 1, as exemplified in FIG. 1(B) or FIG. 3(B), forms a slow port 6 in a ceiling wall 4*b* of a mixing passage 4 so as to face downwards and has a peripheral wall of a fuel-air mixture passage portion 7*a* positioned downstream of the slow port 6 and upstream of a fuel-air mixture inlet 10, which peripheral wall is provided with a liquid fuel receiver 31. Therefore, it has the following advantage.

Fuel oil drops which fall down from the slow port 6 are involved in a current of a fuel-air mixture passing through the mixing passage 4 to accelerate their atomization. The liquid fuel overflowed on a ceiling wall surface of the mixing passage 4 from the slow port 6 is atomized to a certain degree while it is blown downstream along an inner wall surface of the mixing passage 4. The remaining liquid fuel not atomized while it is blown downstream is received by the liquid fuel receiver 31 to accelerate its atomization owing to the action of the mixture current. As such, the liquid fuel which has flowed out of the slow port 6 of the ceiling wall 4*b* of the mixing passage 4 accelerates its atomization before it reaches the mixture inlet 10 of a cylinder head 23 illustrated in FIG. 1(A) or FIG. 3(A). This can uniformly distribute the fuel from the mixture inlet 10 to respective intake ports 12,12 through branched passages 11,11, thereby inhibiting occurrence of the disadvantages caused by the non-uniform distribution of the fuel to respective cylinders, such as mis-ignition and increase of CO concentration in the exhaust gas.

The invention of claim 1, as exemplified in FIG. 1(A) or FIG. 3(A), has the branched passages 11,11 provided within the cylinder head 23. This dispenses with the intake manifold to result in the possibility of decreasing the projection of the carburetor 1 from the cylinder head 23 in an attempt to downsize the engine.

According to an invention of claim 2, as exemplified in FIG. 1(B) or FIG. 3(B), the liquid fuel receiver 31 comprises a groove 8 formed by concaving a ceiling wall 7*b* of the mixture passage portion 7*a*. Therefore, it has the following advantage.

In the case where the mixture current flows at a relatively high speed, most of the liquid fuel overflowed on a ceiling wall surface of the mixing passage 4 from the slow port 6 is blown downstream along the ceiling wall surface of the mixing passage 4. The liquid fuel not atomized while it is blown downstream flows into the groove 8 provided in the ceiling wall 7*b* of the mixture passage portion 7*a* and is received here to accelerate its atomization with the action of a negative pressure produced by the mixture current passing by the vicinity of an opening of the groove 8.

According to an invention of claim 3, as exemplified in FIG. 1(A) or FIG. 3(A), the liquid fuel receiver 31 further includes grooves 8,8 formed by concaving left and right both side walls 7*c*,7*c* of the mixture passage portion 7*a*. Therefore, it has the following advantage.

In the case where the mixture current flows at a relatively low speed, most of the liquid fuel overflowed on the ceiling wall surface of the mixing passage 4 from the slow port 6 is blown downstream first along the ceiling wall surface of the mixing passage 4 and then along left and right both side wall surfaces of the mixing passage 4 while it is gradually falling down by its own weight. The liquid fuel not atomized while it is blown downstream flows into the grooves 8,8 formed in the left and right both side walls 7*c*,7*c* of the mixture passage portion 7*a* and is received here to accelerate its atomization with the action of a negative pressure produced by the mixture current passing by the vicinity of an opening of each of the grooves 8,8.

According to an invention of claim 4, as exemplified in FIG. 1(B) or FIG. 3(B), the liquid fuel receiver 31 comprises a wall 9*a* projecting from the ceiling wall 7*b* of the mixture passage portion 7*a*. This wall 9*a* forms a throttle hole 9 for the mixture. Therefore, it has the following advantage.

The liquid fuel not atomized while it is blown downstream along the ceiling wall surface of the mixing passage 4 is received by the wall 9*a* projecting from the ceiling wall 7*b* of the mixture passage portion 7*a* to accelerate its atomization with the action of a negative pressure produced by the mixture current passing through the throttle hole 9.

According to an invention of claim 5, as exemplified in FIG. 1(A) or FIG. 3(A), the liquid fuel receiver 31 further includes walls 9*a*,9*a* projecting from the left and right both side walls 7*c*,7*c* of the mixture passage portion 7*a*. These walls 9*a*,9*a* form a throttle hole 9 for the mixture. Therefore, it has the following advantage.

The liquid fuel not atomized while it is blown downstream along left and right both side wall surfaces of the mixing passage 4 is received by the walls 9*a*,9*a* projecting from the left and right both side walls 7*c*,7*c* of the mixture passage portion 7*a* to accelerate its atomization with the action of a negative pressure produced by the mixture current passing through the throttle hole 9.

According to an invention of claim 6, as exemplified in FIG. 1(B) or FIG. 3(B), the liquid fuel receiver 31 comprises a groove 8 formed by concaving the ceiling wall 7*b* of the mixture passage portion 7*a* and a wall 9*a* projecting from the ceiling wall 7*b* of the mixture passage portion 7*a*. This wall 9*a* forms a throttle hole 9 for the mixture. Therefore, it has the following advantage.

The liquid fuel not atomized while it is blown downstream along the ceiling wall surface of the mixing passage 4 flows into the groove 8 formed in the ceiling wall 7*b* of the mixture passage portion 7*a*. Although, in some cases, the liquid fuel which has flowed into the groove 8 may tend to flow downstream out of the groove 8 as it remains liquid, with the action of a negative pressure produced by the mixture current passing by the vicinity of an opening of the groove 8, it is assuredly received by the wall 9*a* to accelerate its atomization with the action of a negative pressure produced by each of the mixture current passing by the vicinity of the opening of the groove 8 and the mixture current passing through the throttle hole 9.

Even if the wall 9*a* has a height increased so as to receive the liquid fuel reliably, its projection can be decreased by an amount corresponding to the existence of the groove 8. This inhibits a throttling resistance of the throttle hole 9 from increasing more than necessary to result in the possibility of securing a high output.

According to an invention of claim 7, as exemplified in FIG. 1(A) or FIG. 3(A), the liquid fuel receiver 31 further includes grooves 8,8 formed by concaving the left and right both side walls 7*c*,7*c* of the mixture passage portion 7*a* as well as walls 9*a*,9*a* projecting from the left and right both side walls 7*c*,7*c* of the mixture passage portion 7*a*. Therefore, it has the following advantage.

The liquid fuel not atomized while it is blown downstream along the left and right both side wall surfaces of the mixing passage 4 flows into the grooves 8,8 provided in the left and right both side walls 7*c*,7*c* of the mixture passage portion 7*a* and is received by the walls 9*a*,9*a* surely. Further, even if each of the walls 9*a*,9*a* has its width increased, its projection can be decreased by an amount corresponding to the existence of each of the grooves 8,8.

According to an invention of claim 8, as exemplified in FIGS. 1(A) and 1(B) or FIGS. 3(A) and 3(B), the mixing passage 4 has an outlet 4*a* communicated with the mixture inlet 10 through an insulator 7. The liquid fuel receiver 31 is formed within this insulator 7. Therefore, it has the following advantage.

The molding die for the insulator 7 has a structure simpler than those of the molding dies for a mixing body 1*a* of the carburetor 1 and for the cylinder head 23. Accordingly, when compared with the case of providing the mixing body 1*a* or the like with the liquid fuel receiver 31, less trouble occurs on processing or cutting the molding die for forming the liquid fuel receiver 31.

According to an invention of claim 9, as exemplified in FIGS. 1(A) and 1(B) or FIGS. 3(A) and 3(B), the insulator 7 has a length (L1) smaller than a length (L2) between the slow port 6 and the outlet 4*a* of the mixing passage 4. Therefore, it has the following advantage.

Since the insulator 7 is short, it does not increase a mixture-flow resistance more than necessary and besides can decrease the projection of the carburetor 1 from the cylinder head 23 in an attempt to downsize the engine.

An invention of claim 10, as exemplified in FIG. 1(A) or FIG. 3(A), makes an axis 5*a* of a throttle valve 5 substantially horizontal and forms the branched passages 11,11 in the shape of a letter 'V'. Therefore, it has the following advantage.

The mixture is uniformly distributed in a left and right direction from the throttle valve 5 toward the mixture inlet 10 to result in being uniformly distributed into respective intake ports 12,12 through the V-shaped branched passages 11,11 from the mixture inlet 10. In consequence, it can accelerate uniformization of the mixture to be distributed to respective cylinders.

An invention of claim 11, as exemplified in FIGS. 1(A) and 1(B) or FIGS. 3(A) and 3(B), steps the groove 8 from an opening edge of the outlet 4*a* of the mixing passage 4. Therefore, it has the following advantage.

The liquid fuel not atomized while it is blown downstream along the ceiling wall surface of the mixing passage 4 as well as the left and right both side wall surfaces thereof flows into the groove 8 just after it has flowed out of the outlet 4*a* of the mixing passage 4. Accordingly, the liquid fuel makes a prompt atomization.

An invention of claim 12, as exemplified in FIG. 3(B), does not project the wall 9*a* from a bottom wall 7*d* of the mixture passage portion 7*a*. Therefore, it has the following advantage.

The throttling resistance of the throttle hole 9 does not increase more than necessary due to the absence of the projection of the wall 9*a* from the bottom wall 7*d*.

DESCRIPTION OF THE PREFERRED EMBODIMENTS

Figure 1A:
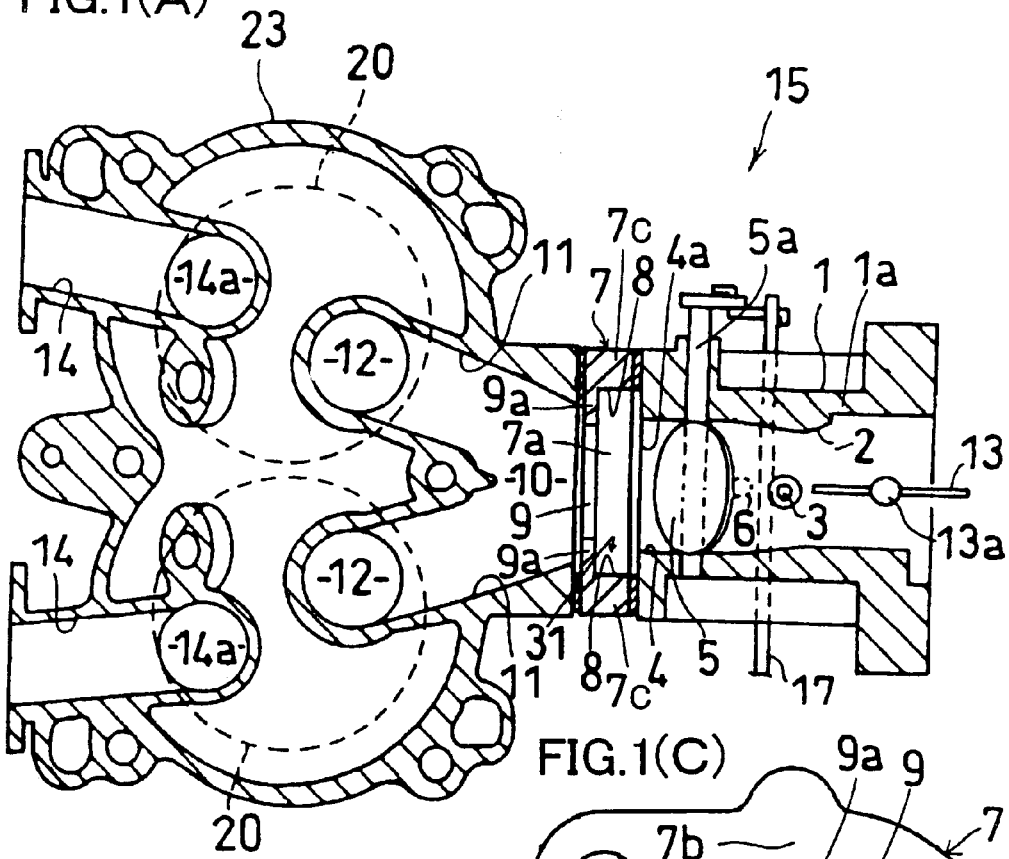
FIG. 1(A) is a horizontal sectional plan view of an intake device for a multi-cylinder engine, according to a first embodiment of the present invention.
Figure 1C:
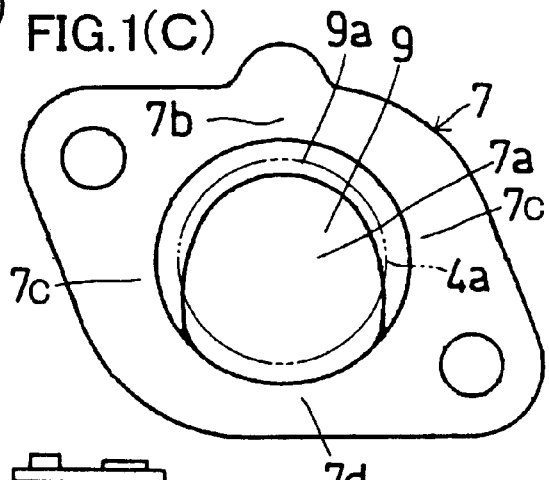
FIG. 1(C) is a front view of an insulator used for the intake device shown in FIG. 1(A)
Figure 1B:
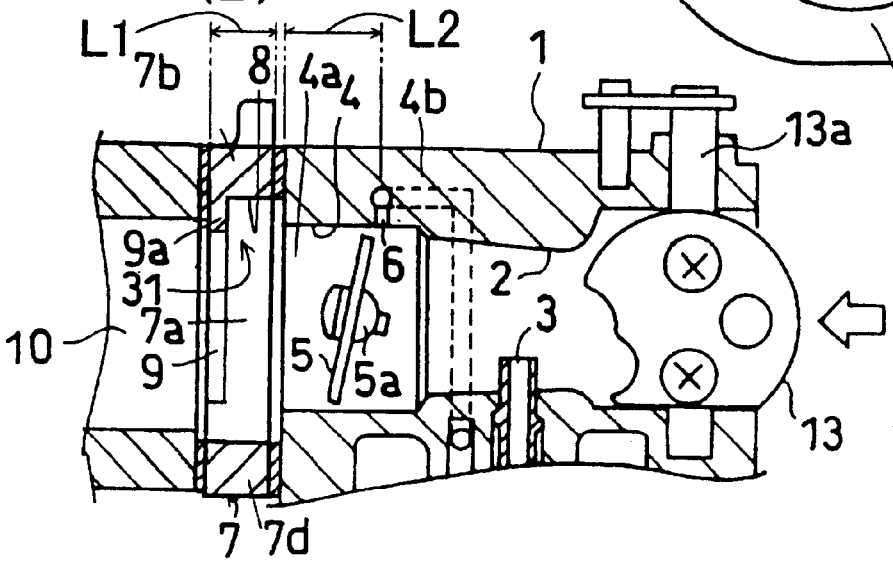
FIG. 1(B) is a vertical sectional side view of an essential part of the intake device shown in FIG. 1(A)
Figure 2:
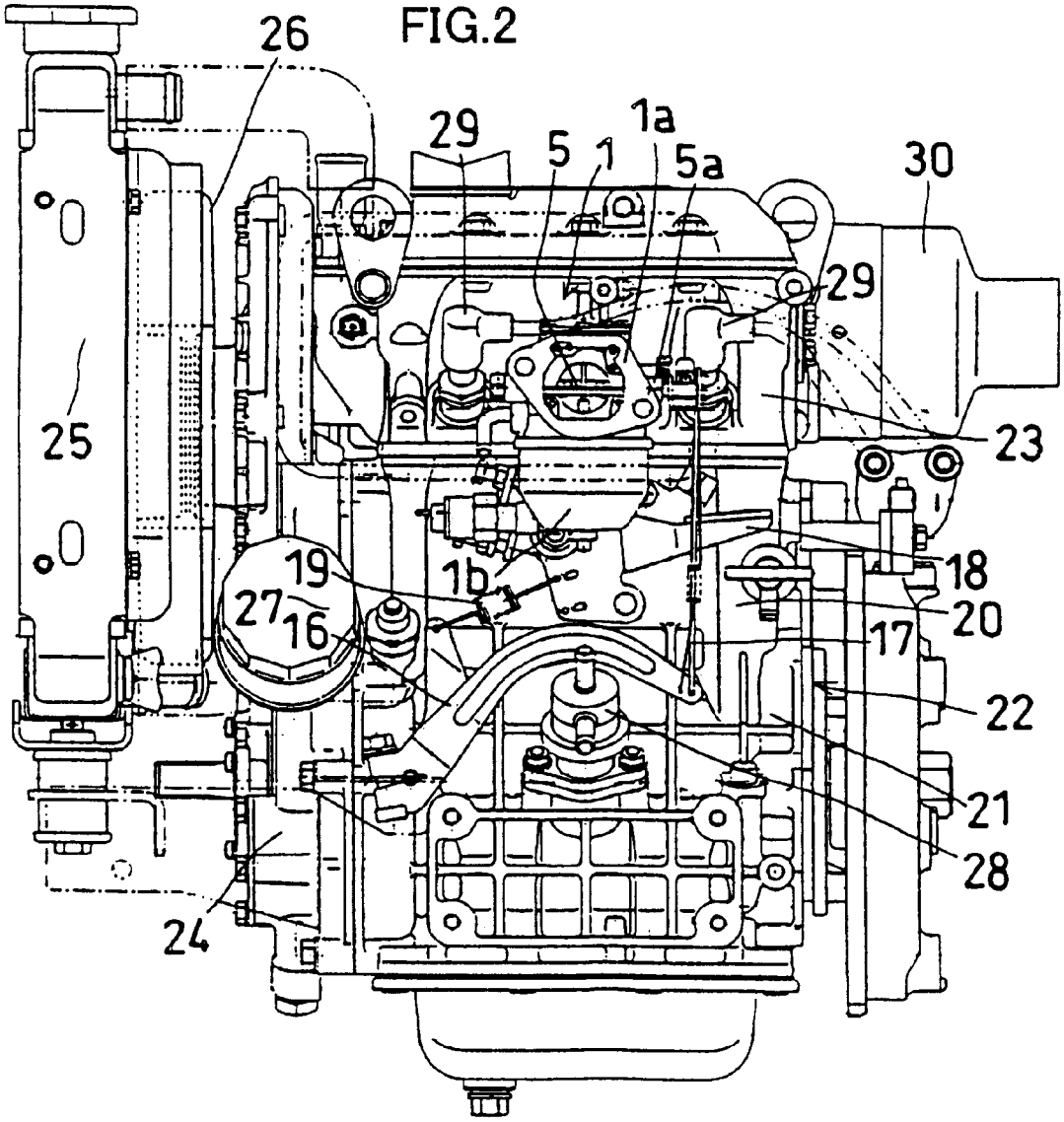
FIG. 2 is a side view of a multi-cylinder engine provided with the intake device shown in FIG. 1(A)

FIGS. 1 to 2 show an intake device for a multi-cylinder engine, according to a first embodiment of the present invention. This engine is a vertical two-cylinder gasoline engine of four-cycle and water-cooled type.

This engine (E) has a construction outlined as follows.

As shown in FIG. 2, a cylinder head 23 is assembled to an upper portion of a cylinder block 22 which comprises a crank case 21 and a cylinder portion 20 formed into an integral structure. A gear case 24 is assembled to a front portion of the cylinder block 22. A radiator 25 and a cooling fan 26 are arranged in front of the gear case 24. A carburetor 1 is assembled to a mid portion of a right side wall of the cylinder head 23 in a front and rear direction. An air cleaner not shown is assembled to the carburetor 1. In FIG. 2, numerals 16, 17, 18 and 19 designate a governor lever, a connecting rod which connects an axis 5*a* of a throttle valve 5 to the governor lever 16, a speed control operation lever, and a governor spring, respectively. Numerals 27, 28, 29 and 30 indicate an oil filter, a fuel pump, an ignition plug and a muffler, respectively.

The engine (E) has an intake device 15 constructed as follows.

As shown in FIG. 1(A), the intake device 15 comprises the carburetor 1, an intake passage within the cylinder head 23 and an insulator 7.

As shown in FIG. 2, the carburetor 1 is attached to a lateral side wall of the cylinder head 23. The carburetor 1 comprises a mixing body 1*a* and a fuel sump 1*b*. As shown in FIGS. 1(A) and 1(B), the mixing body 1*a* has an inner portion formed with a venturi portion 2. The venturi portion 2 is provided with a main nozzle 3. A butterfly choke valve 13 is provided upstream of the venturi portion 2. This choke valve 13 has an axis 13*a* directed substantially vertically. A mixing passage 4 is formed downstream of the main nozzle 3. A butterfly throttle valve 5 is provided within the mixing passage 4. The mixing passage 4 is directed substantially horizontally to the lateral side wall of the cylinder head 23. The throttle valve 5 has an axis 5*a* directed substantially perpendicular to the mixing passage 4 and substantially horizontally. A slow port 6 is formed in a ceiling wall 4*b* of the mixing passage 4 at a position opposite to an outer periphery of the throttle valve 5 so as to face downwards.

As shown in FIG. 1(A), the intake passage within the cylinder head 23 comprises a fuel-air mixture inlet 10, bifurcated passages 11,11 branched from the mixture inlet 10, and intake ports 12, 12 communicated with the respective branched passages 11,11. The mixture inlet 10 is provided by opening the lateral side wall of the cylinder head 23. As shown in FIG. 1(A), when seen in a direction perpendicular to the axis 5*a* of the throttle valve 5, the branched passages 11,11 are formed in the shape of a letter 'V'.

The insulator 7 has a mixture passage portion 7*a* at its mid portion. This insulator 7 is sandwiched between the carburetor 1 and the cylinder head 23. The mixture passage portion 7*a* of the insulator 7 is arranged between an outlet 4*a* of the mixing passage 4 of the carburetor 1 and the mixture inlet 10 of the cylinder head 23 to communicate them with each other. Thus the mixture passage portion 7*a* is positioned downstream of the slow port 6 and upstream of the mixture inlet 10. The insulator 7 has a length (L1) smaller than a length (L2) between the slow port 6 and the outlet 4*a* of the mixing passage 4.

This mixture passage portion 7*a* is provided with a liquid fuel receiver 31 which comprises a groove 8 and a wall 9*a*. The groove 8 is provided by continuously concaving a ceiling wall 7*b* of the mixture passage portion 7*a* as well as left and right both side walls 7*c*,7*c* thereof. This groove 8 is formed in the shape of a letter 'U' in section by an inner wall surface of a recess provided by concaving the insulator 7, which has a L-shaped section, and by a flat end wall surface of an opening peripheral edge portion of the outlet 4*a* of the mixing passage 4. Further, it is stepped from the opening edge of the outlet 4a of the mixing passage 4.

The wall 9*a* projects toward a center of the mixture passage portion 7*a* from the ceiling wall 7*b* and the left and right both side walls 7*c*,7*c* of the mixture passage portion 7*a*. This wall 9*a* is continuously provided and forms a throttle hole 9 for the mixture at a mid portion of the mixture passage portion 7*a*. The wall 9*a* is not formed on a bottom surface of the mixture passage portion 7*a*. As shown in FIG. 1(C), when seen in a direction parallel to an axial direction of a center axis of the mixing passage 4, the wall 9*a* has an inner edge portion which projects inwards more than the opening edge of the outlet 4*a* of the mixing passage 4, except its left and right both lower end portions.

In FIG. 1(A) numeral 14 designates an exhaust passage and numeral 14*a* indicates an exhaust port.

Figure 3A:
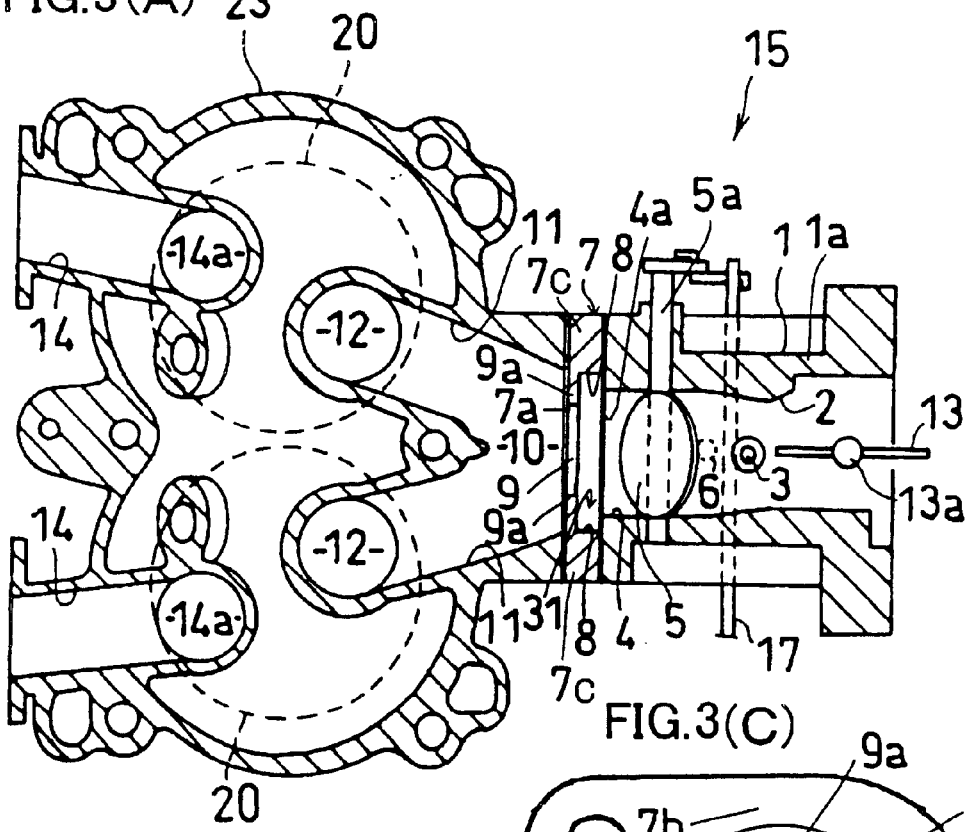
FIG. 3(A) is a horizontal sectional plan view of an intake device for a multi-cylinder engine, according to a second embodiment of the present invention.
Figure 3C:
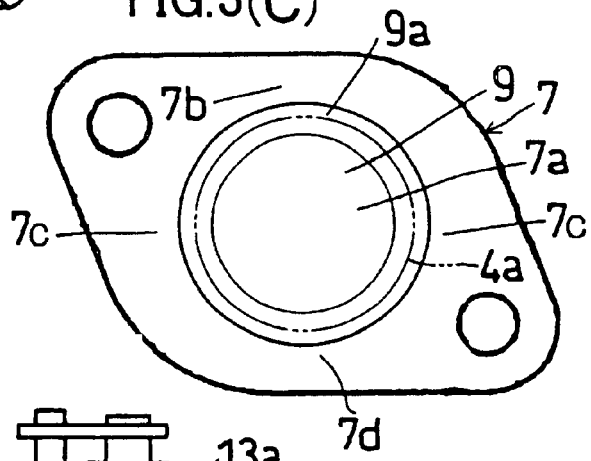
FIG. 3(C) is a front view of an insulator used in the intake device shown in FIG. 3(A).
Figure 3B:
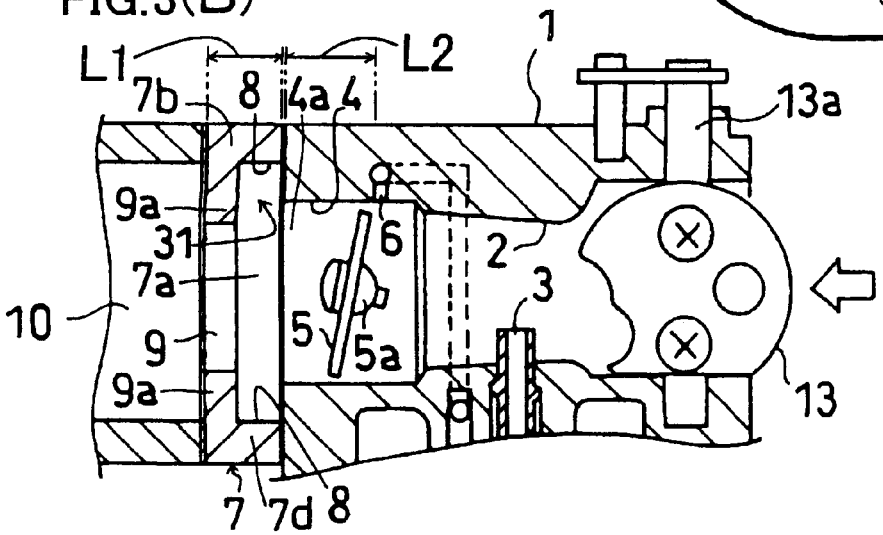
FIG. 3(B) is a vertical sectional side view of an essential part of the intake device shown in FIG. 3(A)

A second embodiment shown in FIG. 3 forms the groove 8 in the shape of a ring continuous over an entire periphery of the mixture passage portion 7*a*. Further, it also forms the wall 9*a* in the shape of a ring continuous over the entire periphery of the mixture passage portion 7*a*. As shown in FIG. 3(C), when the insulator 7 is seen from its front, the throttle hole 9 is formed circular. As shown in FIG. 3(C), when seen in the direction parallel to the axial direction of the center axis of the mixing passage 4, the wall 9*a* has an inner peripheral edge portion which projects inwards more than the opening edge of the outlet 4*a* of the mixing passage 4. The other construction is the same as that of the first embodiment. In FIG. 3(A) to FIG. 3(C), the same elements as shown in FIG. 1(A) to FIG. 1(C) are designated by same characters as those in FIG. 1(A) to FIG. 1(C). In the second embodiment, even if the liquid fuel which has flowed into the groove 8 falls down to the bottom surface of the mixture passage portion 7*a*, it is received by the wall 9*a* and therefore hardly flows downstream out of the groove 8 to thereby accelerate its atomization.

The embodiments of the present invention are as mentioned above in contents. But the present invention is not limited to these embodiments. The following modifications are possible so far as they don't contradict the effect of the present invention.

The liquid fuel receiver 31 may comprise only a groove 8 or only a wall 9*a*. Only the ceiling wall 7*b* of the mixture passage portion 7*a* is provided with the liquid fuel receiver 31. Further, merely the left and right both side walls 7*c*,7*c* are provided with the liquid fuel receiver 31. The liquid fuel receiver 31 may be formed within the mixing passage 4 of the carburetor 1.

What is claimed is:

1. An intake device for a multi-cylinder engine comprising a carburetor (1) which has a venturi portion (2) provided with a main nozzle (3), a throttle valve (5) being provided within a mixing passage (4) positioned downstream of the main nozzle (3), a slow port (6) being provided in a wall of the mixing passage (4) at a position opposite to an outer periphery of the throttle valve (5), a cylinder head (23) having an inner portion provided with a fuel-air mixture inlet (10), passages (11),(11) branched from the mixture inlet (10) and intake ports (12),(12) communicated with the respective branched passages (11),(11), the mixing passage (4) having an outlet (4*a*) communicated with the mixture inlet (10), the slow port (6) being formed in a ceiling wall (4*b*) of the mixing passage (4) so as to face downwards, a mixture passage portion (7*a*) positioned downstream of the slow port (6) and upstream of the mixture inlet (10) having a peripheral wall provided with a liquid fuel receiver (31).

2. The intake device for a multi-cylinder engine as set forth in claim 1, wherein the liquid fuel receiver (31) comprises a groove (8) formed by concaving a ceiling wall (7*b*) of the mixture passage portion (7*a*).

3. The intake device for a multi-cylinder engine as set forth in claim 2, wherein the liquid fuel receiver (31) further includes grooves (8),(8) provided by concaving left and right both side walls (7*c*),(7*c*) of the mixture passage portion (7*a*).

4. The intake device for a multi-cylinder engine as set forth in claim 2, wherein the groove (8) is stepped from an opening edge of the outlet (4*a*) of the mixing passage (4).

5. The intake device for a multi-cylinder engine as set forth in claim 1, wherein the liquid fuel receiver (31) comprises a wall (9*a*) which projects from a ceiling wall (7*b*) of the mixture passage portion (7*a*) toward a center of the mixture passage portion (7*a*), the wall (9*a*) forming a throttle hole for the mixture within the mixture passage portion (7*a*).

6. The intake device for a multi-cylinder engine as set forth in claim 4, wherein the liquid fuel receiver (31) further includes walls **(9*a*),(9*a*) which projects from left and right both side walls (7*c*),(7*c*) of the mixture passage portion 7(*a*) toward the center of the mixture passage portion (7*a*)**.

7. The intake device for a multi-cylinder engine as set forth in claim 1, wherein the liquid fuel receiver (31) comprises a groove (8) formed by concaving a ceiling wall **(7*b*) of the mixture passage portion (7*a*) and a wall (9*a*) projecting from the ceiling wall (7*b*) of the mixture passage portion (7*a*) toward a center of the mixture passage portion (7*a*), the wall (9*a*) forming a throttle hole (9) for the mixture within the mixture passage portion (7*a*)**.

8. The intake device for a multi-cylinder engine as set forth in claim 7, wherein the liquid fuel receiver (31) further includes grooves (8),(8) formed by concaving left and right both side walls **(7*c*),(7*c*) of the mixture passage portion (7*a*) and walls (9*a*),(9*a*) projecting from the left and right both side walls (7*c*),(7*c*) of the mixture passage portion (7*a*) toward the center of the mixture passage portion (7*a*)**.

9. The intake device for a multi-cylinder engine as set forth in claim 1, wherein the mixing passage (4) has an outlet **(4*a*) communicated with the mixture inlet (10) through an insulator (7), within which the liquid fuel receiver (31)** is formed.

10. The intake device for a multi-cylinder engine as set forth in claim 9, wherein the insulator (7) has a length (L1) smaller than a length (L2) between the slow port (6) and the outlet **(4*a*) of the mixing passage (4)**.

11. The intake device for a multi-cylinder engine as set forth in claim 1, wherein the throttle valve (5) has an axis **(5*a*) substantially horizontal, and when seen in a direction perpendicular to the axis (5*a*)**, the branched passages are formed in the shape of a letter 'V'.

12. An intake device for a multi-cylinder engine comprising a carburetor (1) which has a venturi portion (2) provided with a main nozzle (3), a throttle valve (5) being provided within a mixing passage (4) positioned downstream of the main nozzle (3), a slow port (6) being provided in a wall of the mixing passage (4) at a position opposite to an outer periphery of the throttle valve (5), a cylinder head (23) having an inner portion provided with a fuel-air mixture inlet (10), passages (11),(11) branched from the mixture inlet (10) and intake ports (12),(12) communicated with the respective branched passages (11),(11), the mixing passage (4) having an outlet **(4*a*) communicated with the mixture inlet (10), the slow port (6) being formed in a ceiling wall (4*b*) of the mixing passage (4) so as to face downwards, a mixture passage portion (7*a*) positioned downstream of the slow port (6) and upstream of the mixture inlet (10) having a peripheral wall provided with a liquid fuel receiver (31), the liquid fuel receiver (31) comprising a wall (9*a*) which projects from a ceiling wall (7*b*) and left and right side walls (7*c*),(7*c*) of the mixture passage portion (7*a*) toward a center of the mixture passage portion (7*a*), the wall (9*a*) forming a throttle hole (9) for the mixture within the mixture passage portion (7*a*), wherein the wall (9*a*) does not project from a bottom wall (7*d*) of the mixture passage portion (7*a*)**.

13. The intake device for a multi-cylinder engine as set forth in claim 12, wherein the liquid fuel receiver 31 further includes a groove (8) formed by concaving the ceiling wall **(7*b*) of the mixture passage portion (7*a*)**.

14. The intake device for a multi-cylinder engine as set forth in claim 12, wherein the liquid fuel receiver (31) further includes a groove (8) formed by concaving the left and right side walls **(7*c*),(7*c*) of the mixture passage portion (7*a*)**.

15. The intake device for a multi-cylinder engine as set forth in claim 12, wherein the liquid fuel receiver (31) further includes a groove (8) by concaving the ceiling wall **(7*b*) and the left and right side walls (7*c*),(7*c*) of the mixture passage portion (7*a*)**.

16. The intake device for a multi-cylinder engine as set fort in claim 12, wherein the mixing passage (4) has an outlet **(4*a*) communicated with the mixture inlet (10) through an insulator (7), within which the liquid fuel receiver (31)** is formed.

17. The intake device for a multi-cylinder engine as set forth in claim 16, wherein the insulator (7) has a length (L1) smaller than a length (L2) between the slow port (6) and the outlet **(4*a*) of the mixing passage (4)**.

18. The intake device for a multi-cylinder engine as set forth in claim 12, wherein the throttle valve (5) has an axis **(5*a*) substantially horizontal, and when seen in a direction perpendicular to the axis (5*a*), the branched passages (11), (11)** are formed in the shape of a letter 'V'.

19. The intake device for a multi-cylinder engine as set forth in claim 12, wherein the groove (8) is stepped from an opening edge of the outlet **(4*a*) of the mixing passage 4**.

* * * * *